United States Patent [19]

Hogg

[11] Patent Number: 4,619,430

[45] Date of Patent: Oct. 28, 1986

[54] PICTURE FRAME HANGER

[75] Inventor: James W. Hogg, Nashville, Tenn.

[73] Assignee: Anchor Wire Corporation of Tennessee, Goodlettsville, Tenn.

[21] Appl. No.: 594,395

[22] Filed: Mar. 28, 1984

Related U.S. Application Data

[63] Continuation-in-part of Ser. No. 393,550, May 30, 1982, Pat. No. 4,485,995, which is a continuation-in-part of Ser. No. 268,499, May 29, 1981, Pat. No. 4,422,608.

[51] Int. Cl.[4] ..... A47G 1/16

[52] U.S. Cl. ..... 248/467; 248/216.1; 248/218.1; 248/493

[58] Field of Search ..... 248/467, 216.1, 216.4, 248/218.1, 218.2, 218.3, 221.2, 222.2, 225.2, 225.1, 217.2, 473, 489, 231.91, 493; 40/152.1, 152

[56] References Cited

U.S. PATENT DOCUMENTS

| | | | |
|---|---|---|---|
| D. 42,970 | 9/1912 | Larsson | D8/371 |
| 674,438 | 5/1901 | Edmundson et al. | 148/301 |
| 789,524 | 5/1905 | Bradley | 248/218.1 |
| 992,203 | 5/1911 | Johnson | 148/301 |
| 1,161,268 | 11/1915 | Tuck | 248/493 |
| 1,284,035 | 11/1918 | Anderson | 248/218.1 |
| 1,652,648 | 12/1927 | Swangren | 411/544 |
| 2,330,373 | 9/1943 | Moore | 248/493 |
| 2,334,700 | 11/1943 | Frey | 248/493 |
| 2,676,508 | 4/1954 | Erickson | 411/441 |
| 2,968,984 | 1/1961 | De Caro | 411/441 |
| 3,137,195 | 6/1964 | Rosenberg, Jr. | 411/441 |
| 3,298,651 | 1/1967 | Passer | 248/217.2 |
| 3,300,173 | 1/1967 | Kennedy, Jr. | 248/498 |
| 3,350,045 | 10/1967 | Mayers | 248/467 |
| 3,457,825 | 7/1969 | Caty | 411/544 |
| 3,490,329 | 1/1970 | Pratorius | 411/441 |
| 3,516,323 | 6/1970 | O'Brien | 411/441 |
| 3,879,006 | 4/1975 | Staudte | 248/221.2 |
| 3,912,211 | 10/1975 | Topf | 248/217 |
| 3,985,324 | 10/1976 | Larson | 248/221.1 |
| 4,026,510 | 5/1977 | Holmes | 248/216.1 |
| 4,286,496 | 9/1981 | Harris | 411/441 |
| 4,317,555 | 3/1982 | Hogg | 248/467 |
| 4,422,608 | 12/1983 | Hogg | 248/205 A |
| 4,485,995 | 12/1984 | Hogg | 248/218.1 |

FOREIGN PATENT DOCUMENTS

| | | | |
|---|---|---|---|
| 37392 | 7/1923 | Norway | 248/217.2 |

*Primary Examiner*—Ramon O. Ramirez
*Attorney, Agent, or Firm*—Fisher, Christen & Sabol

[57] ABSTRACT

A device, such as a picture frame hanger, for supporting a flexible, elongated article, such as a picture frame having a convex lip fastened to a backplate so that an arched groove and a circular contact area are formed. The flexible, elongated article hangs on the curved top surface of the contact area and freely from either side of the arched groove and presses against the backplate when seated within the groove. The device can be anchored to a wall or other suitable surface in a manner which prevents the twisting or movement thereof under load or contact.

19 Claims, 12 Drawing Figures

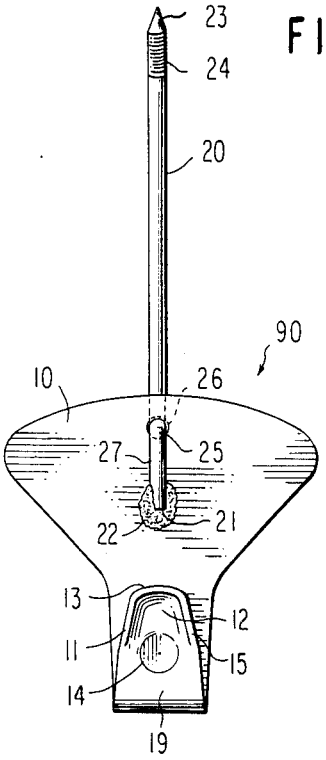
FIG. 1
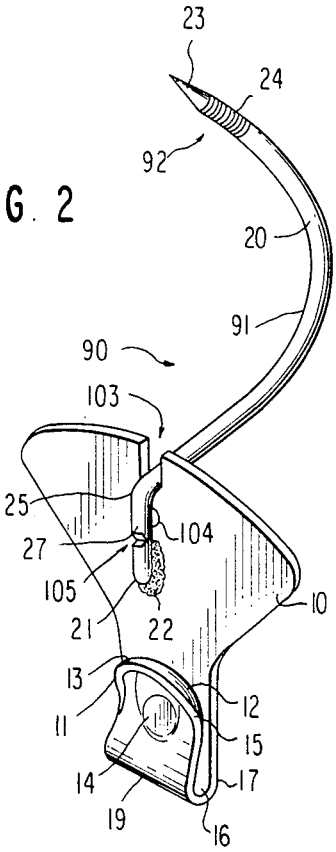
FIG. 2
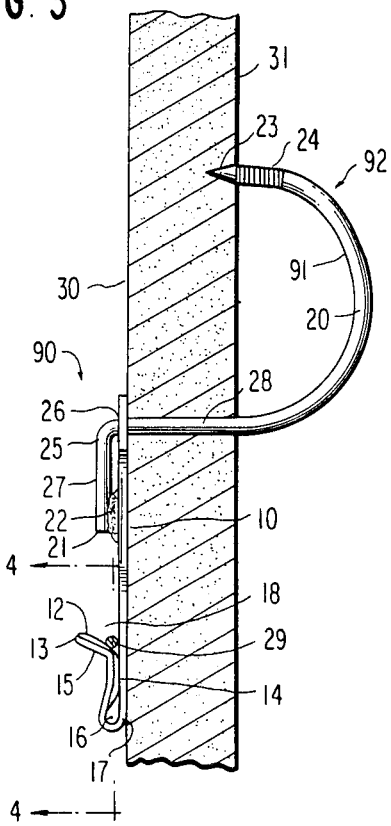
FIG. 3
FIG. 8
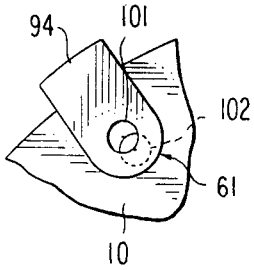
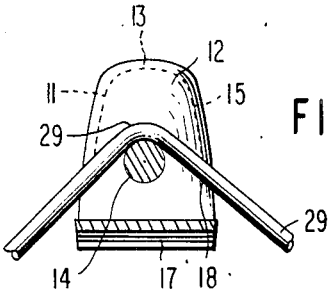
FIG. 4
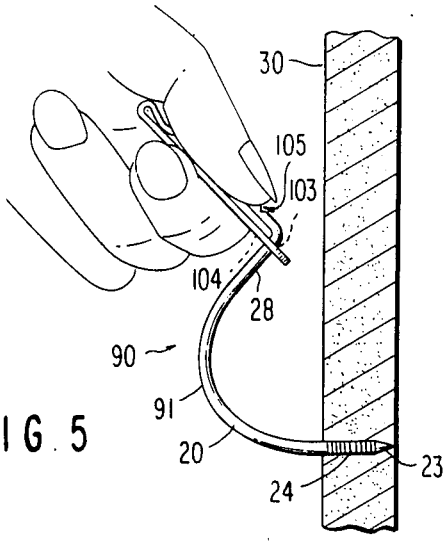
FIG. 5

PICTURE FRAME HANGER

This is a continuation-in-part of U.S. Ser. No. 393,550, now U.S. Pat. No. 4,485,995 filed on June 30, 1982, which is a continuation-in-part of U.S. Ser. No. 268,499, filed May 29, 1981, now U.S. Pat. No. 4,422,608.

BACKGROUND OF THE INVENTION

1. Field Of The Invention

The invention relates to devices for supporting objects from a flexible, elongated article, and in particular, to a picture hanger.

2. Prior Art

Over the years patents have been issued for various frame picture hangers. Two problems, however, are typical of known picture hangers. First, picture hangers are typically stamped from sheet metal and one end is curved to form a U-shaped hook. The wire fastened to a picture frame is suspended from such hook. Because the edges of the U-shaped hook are sharp, the wire becomes frayed and is damaged with use.

Second, because of the U-shaped portion of the hook, there is a lot of play when the wire is placed in the hook. The wire tends to move in the bight of the U-shaped portion away from the wall causing a lever action on the anchor fastening the picture hanger to the wall. Because the anchor is usually a nail, the lever action loosens the nail causing the hanger to sag and sometimes to become loose.

U.S. Pat. No. 1,161,268 (Tuck) attempts to solve these problems by stamping out a narrow tongue from a backplate and rolling it out away from the backplate to form a curved wedge into which a frame wire will be placed. Furthermore, Tuck discloses the use of nails to secure the picture hanger to a wall.

See also U.S. Pat. Nos. 647,738, 992,203, 2,330,373, 2,334,700, 3,912,211 and 4,286,496, and U.S. Dsgn. Pat. No. Der. 42,970.

BROAD DESCRIPTION OF THE INVENTION

An object of the invention is to provide a device, such as a picture hanger, for supporting objects having a flexible, elongated handing means. Another object of the invention is to provide such a device which eliminates the prior art problems set out above. Other objects and advantages of the invention are set out herein or are obvious herefrom to one ordinarily skilled in the art.

The objects and advantages of the invention are achieved by the picture hangers or object-supporting devices of the invention.

The invention involves a device for supporting objects having a flexible, elongated hanging means. In accordance with the illustrative embodiment of the invention, a groove and a contact area, having a smooth, curved top surface, is formed by connecting a convex shaped lip with a backplate. An elongated, flexible object, like a wire supporting a picture frame, when placed over the convex shaped lip, slides down into the groove, contacts the top surface of the contact area, and is tucked against the backplate. Because the point of connection between the convex lip and the backplate forms a groove and a contact area which is arced, the elongated, flexible object follows the contour of the arced contact area. As a result, the flexible object remains intact and is life lengthened by not contacting sharp edges or being supported by a surface having a printed or sharp area.

The preferred embodiment of the aforementioned invention relates to a device for hanging a picture frame from a wall. An anchor is provided for securing the backplate to the wall. One embodiment of the anchor uses an elongated, spring rod, one end of which is fixed to the backplate. The other end of the elongated, spring rod is pointed. Adjacent to the pointed end, the elongated, spring rod is fluted or threaded so that by twisting the rod and by supplying pressure, the rod can be forced through a hollow wall made of wallboard or sheetrock (or plasterboard) or the like at an angle perpendicular to the wall. The elongated, spring rod is sufficiently long and curved that after penetrating the wall, and when the backplate is firmly lodged against the wall, the pointed end curves into and digs in the inner surface of the wall. When a picture frame is hung by placing the frame wire in the groove in contact with contact area, the pointed end of the rod restrains the backplate from separating from the wall. Furthermore, the wire remains adjacent to the backplate. Due to the spring effect of the rod on the inner surface of the wall and due to the fact that the load effect of the picture frame has an essentially new moment arm on torque effect, the backplate of the device digs into the relatively soft wall (which helps prevent twisting of the device and helps increase the load capacity of the hanger device).

In another embodiment, the elongated, spring rod forms a right angle instead of being curved. One of the arms of the right angle is slightly longer than the thickness of the backplate and the thickness of the wall. The other arm lies substantially vertically along the inner surface of the wall and grips the wall. This embodiment is useful with hollow wall paneling.

If the wall is made of concrete or mortar for brick, the backplate can be fastened to the wall by driving a nail or a screw through a tight fitting hole provided in the backplate into the wall. A flexible sleeve is contained around the shaft of the nail in order to act like a shock absorber and to lessen the chances of shattering the wall. Nails or screws can also be used where the backplate has one or more holes in the top thereof. Three offset holes are preferred.

In yet other situations where the aforementioned anchors and attachment means are not suitable, or not completely suitable, the backplate can be fastened to the wall by using an adhesive material between the backplate and the wall. Preferably animal or vegetable adhesive tape is used for adherence to wallboard. Preferably, for paneling, a pressure sensitive adhesive over a foam layer is used. Since the hanger wire fits in a locked manner in the groove of the hanger at the contact area right against the backplate, there is not any moment arm caused by the hung picture frame. Accordingly, about 100 percent increase in the load weight is achieved for any attachment means used. Much longer load weight can be carried with adhesive attachment of the hangers to a wall.

An advantage of the invention resides in the use of a groove and an arched contact area to support the picture frame wire. Because the contact is arced (that is, its top surface is convex and smooth), the wire is not exposed to sharp edges and its life is lengthened.

Another advantage resides in the means for securing the backplate firmly against the wall. Because of the convex surface of the lip, the wire will be forced down into the groove directly against the backplate (and the contact area). The weight applied by the picture frame to the wire will pull directly down on the backplate. The friction between the backplate and the wall reinforces the anchor.

Yet another advantage resides in the use of a elongated, spring rod to anchor the backplate to a wall where the architecture permits. In one case, the rod digs into the inner surface of the wall, restraining the backplate from being pulled away from the wall.

BRIEF DESCRIPTION OF THE DRAWINGS

In the drawings:

FIG. 1 is a front elevational view of the most preferred embodiment of the picture hanger of the invention for attachment of hollow wall sheetrock or wallboard;

FIG. 2 is a perspective view of the picture hanger of FIG. 1;

FIG. 3 is a side elevational view of the picture hanger of FIG. 1;

FIG. 4 is a section 4—4 taken through the picture hanger of FIG. 3;

FIG. 5 illustrates how the picture hanger of FIG. 1 can be manually anchored to a wall;

FIG. 8 is a partial perspective view showing some of the details of the anchoring means shown in FIG. 7;

DETAILED DESCRIPTION OF THE INVENTION

Figure 6:
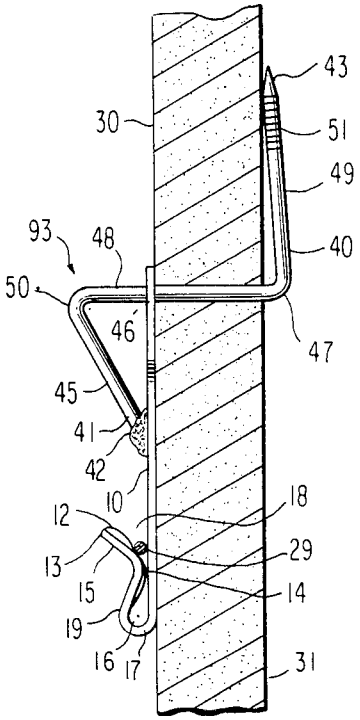
FIG. 6 is a side elevational view of a preferred embodiment of the picture hanger of the invention for attachment to hollow wall panelling.

Referring to FIGS. 1 to 5, which illustrates a preferred embodiment of wall or picture frame hanger 90 to be used on hollow wall wallboard and sheetrock, there is shown backplate member 10 indicated and wire fastening, spring rod member 20, which is made of a strong, spring material such as spring steel. One end section 24 of rod member 20 terminates in sharply pointed section 92 for use in initially penetrating a wall 30 to which hanger 90 is to be applied. The end section 92 can be smoothly tapered, can be provided with one or more lengthwise flat sides, or be provided with a threaded auger-type surface (as shown in FIG. 1) to aid in the penetration of wall 30.

Referring to FIG. 1, picture frame hanger 90 shows lip 12 on the bottom edge of backplate 10. Lip 12 is generally U-shaped, as seen in FIGS. 2 and 3. Lip 12 has a convex surface facing backplate 10 and making contact therewith (indicated by numeral 14) to form a groove therebetween capable of receiving a flexible, elongated article such as a wire or cord from which is suspended, for example, a picture frame (not shown). Because the surface of lip 12 is convexed towards backplate 10, groove 18 formed therebetween will be arced so that wire or cord 29 from a picture frame will hang smoothly on either side of groove 18. Edges 11, 13 and 15 or lip 12 are shaped facing away from backplate 10 and do not make contact with wire or cord 18 of a picture frame (See FIG. 4). As a result, the life of wire or cord 29 is lengthened.

FIG. 2 shows a clearer view of lip 12 and backplate 10 making contact at area 14 to form arced groove 18. Contact area 14 is flat and has a curved top portion which provides a smooth contact region with wire 29. Lower portion 19 of lip 12 and lower portion 17 of backplate 10 are joined to form bight 16 for strengthening picture hanger 90. FIG. 3 shows more detail of contoured lip 12 forming groove 18 with backplate 10 at contact area 14. Lip 12 is welded or soldered to backplate 10 at area 14, that is the area of connection therebetween which is shown partially hatched in FIG. 4. Wire section 29 for suspending a picture frame (not shown) is shown. Wire section 29 is lodged in groove 18 in intimate contact with connection area 14 and firmly between the contoured surface of lip 12 and backplate 10 (see in FIG. 3), but not in contact with edges 11, 13 and 15. When wire 29, from which is suspended a picture frame, is placed over convex lip 12, wire 29 slides down into the arced groove 18 formed between lip 12 and backplate 10 into contact with contact area 14. Wire 29 rests against backplate 10 and forces backplate 10 against wall 30 (see FIG. 3), or some other suitable surface to which backplate 10 is anchored. Accordingly, wire 29 can be locked into a level position and will not slide under pressure caused by the dusting of the picture frame. Also, no movement of force is caused by the load created by the hanging picture frame. When wire 29 is removed from the picture hanger 90, because wire 29 is supported by arced groove 18 having a smooth contoured surface, and because of the absence of sharp edges in the support surface, wire 29 is easily removed and remains intact, free from frayed edges.

Elongated, spring rod 20 is used for anchoring backplate 10 to hollow wall 30. Wall 30 is a hollow wall sheetrock or wallboard. End 21 of rod 20 is fastened to backplate 10 by a weld at 22 (any other suitable fastening means can also be used). End 21 is connected to straight portion 27 of rod 20, which is terminated at point 25 in an approximate right angle (see FIGS. 3 and 5). Rod 20 continues with short straight portion 28. Rod portion 28 fits tightly in hole 26 located in the top center portion of backplate 10. See FIG. 3. Rod portion 28 has preferably a length which is approximately the thickness of wall 30, but must have a length which is at least the thickness of wall 30. Accordingly, wire 29 can be locked into a level position and will not slide under pressure caused by the dusting of the picture frame. Rod portion 28 should be long enough to accommodate penetration through the normal sizes of wallboard (e.g. $\frac{1}{2}$ inch or $\frac{5}{8}$ inch)—the spring effect from arm 91 allows the handling of different thicknesses of panelling with one length of arm 28 (even when a load engages the back on backplate 10). Convex portion 91 of rod 20 faces the back of backplate 10. Other end 92 of rod 20 is straight and has sharp point 23 for perforating the surface of wall 30. Area 24, adjacent to point end 23 or rod 20, is threaded or fluted so as to permit penetration through wall 30 by manually twisting the pin as shown in FIG. 5.

In more detail and referring to FIG. 5, hanger 90 is mounted or installed by first forcing point 23 and penetrating portion 92 of the rod 20 through wall 30 in a horizontal direction. Once penetration is to the end of portion 20, gently curved portion 91 of rod 20 permits the continued smooth entry of rod 20 through wall 30. Backplate 10 swings downwards and towards wall 30 below the entry hole therein. After passage of curved portion 91, straight segment 28 of rod 28 fits into the entry hole in wall 30 and is pushed therethrough until stopped by backplate 10. Accordingly, backplate 10 firmly contacts wall 30 (see FIG. 3). When backplate 10 is set firmly against wall 30, pointed, sharp end 23 of rod 20 is generally perpendicular to inner surface 31 of wall 30 and digs into inner surface 31 of wall 30. The final pressure on the hanger snaps the backplate and rod point into place. Sharp end 23 of rod 20 extends sufficiently past the beginning convex portion 91 (near straight portion 28) so as to assure that sharp end 30 penetrates into inner surface 31 of wall 30.

When wire section 29 is placed in groove 18, the weight from the picture frame (not shown) pulls wire 29 against backplate 10 and snugly into groove 18 in contact with contact area 14 and applies a force substantially downwards along the face of backplate 10. Sharp point 23 of rod 20, however, digs into inner surface 31 of wall 30 and inhibits the separation of backplate 10 from wall 30. Because the surface of backplate 10 rests firmly against the surface of wall 30, the friction between the aforesaid surfaces also holds backplate 10 firmly against wall 30. The fact that section 28 of rod snugly passes through hole 26 in backplate 10 positively prevents any twisting of backplate 10 with respect to rod 20. An exact fit of section 28 of rod 28 in hole 26 is essential to insure that backplate 10 does not wobble around.

Backplate 10 bight 16 and lip 12 can be fabricated from a single piece of sheet metal by stamping out the desired shape, shown in FIGS. 1 to 5, and shaping bight 16 and lip 12 by bending one end of the stamped sheet metal. Furthermore, lip 12 and backplate 10 can be connected by welding the metal at contact area 14. Alternatively, the picture hanger can be formed by pouring a metal or injecting a non-metal material, such as a plastic, into a die.

If wall 30 is curved, backplate 10 can be formed to have the same curve.

To increase the stability and load-carrying capacity of hanger 90, the rear surface of backplate 10 can also be provided with an adhesive provided with a protective removable layer (not shown).

Instead of passing through hole 26 in backplate 10, arm segment 28 of rod 20 can pass through U-shaped slot 103 in the top of backplate 10. This arrangement provides a breakaway feature in case point 23 of rod 20 encounters a stud or the like behind wall 30. The breakaway feature is provided by welding 22 being weak enough that rod 20 can be broken away from backplate 10 or by transverse slot 105 that allows the breaking of rod 20. Once rod 20 is broken or removed, hole 104 in backplate 10 is exposed and it can be used to nail backplate 10 to wall 30. (The same feature can be used with the hanger embodiment shown in FIGS. 7 and 8.)

The embodiment shown in FIGS. 1 to 5 is not normally used with panelling.

Another embodiment of the means for anchoring backplate 10 to wall 30 using elongated, spring bit or rod 40 is shown in FIG. 6, which shows hanger 93. This embodiment is useful with hollow wall panelling which is mounted using furring strips to a wall. End 41 of rod 40 is secured at area 42 to backplate 10. The means of securing rod 40 at area 42 to backplate 10 can be by a weld if the two are metals capable of being welded together (any other suitable attachment means can be used). Backplate 10 is the same as described above for FIGS. 1 to 5. Straight segment 45 of rod 40 away from weld 42 is shaped to move away from the face of backplate 10 and then bent at point 50 so that straight segment 48 passes through hole 46 in backplate 10 and the thickness of wall 30. Hole 46 is located in the top center part of backplate 10. Segment 48 tightly fits in hole 46. Segment 48 of rod 40 is substantially perpendicular to the surface of wall 30. Rod 40 is again bent at point 47 so that remaining segment 49 of rod 40 is substantially perpendicular to segment 48 of rod 40 but is slightly bent towards backplate 10 as shown in FIG. 6. Segment 49 rests along inner surface 31 of wall 30 and points away from backplate 10. Arm 48 should be long enough to accommodate penetration through the normal sizes of panelling (e.g., ⅛ inch and 3/16 inch)—the spring effect from arm 49 allows the handling of different thicknesses of panelling with one length of arm 48 (even when a load engages the hook on backplate 10). Segment 49 of rod 40 provides a spring action against inner surface 31 of wall 30 that holds backplate 10 against wall 30. Such spring action and point action prevents any twisting of backplate 10 in relation to rod 40. Pointed end 43 is only a pressure point and does not dig into inner surface due to the furring strips (which are too hard to easily dig into).

In yet other embodiments, not shown, it is possible for rod 20 or 40 to have a shape somewhat different from that shown in FIGS. 3 and 6 hereinabove but perform substantially the same function.

End 43 of rod is pointed for perforating the surface of wall 30. Surfaces 51 or rod 49 adjacent to end 43 is fluted, threaded, or the like, to permit penetration through wall 30. The method of penetrating wall 39 is similar to that shown in FIG. 5, in connection with the disclosure of another embodiment. Point 43 of rod 40 is pressed into wall 30 in a manner whereby segment 49 of rod 40 is perpendicular to wall 30. When bend 47 is reached, backplate 10 is manipulated downwards so as to allow segment 48 of rod 40 to pass into the hole in wall 30 until backplate 10 is firmly situated against wall 30. Arm 48 is shown as being long enough to extend a shortways through the hole in wall 30. Arm 48 should be long enough to accommodate penetration through the normal sizes of panelling (e.g., ⅛ inch and 3/16 inch)—the spring effect from arm 49 allows the handling of different thicknesses of panelling with one length of arm 48 (even when a load engages the hook on backplate 10). Point 43 is a pressure point against back side 31 of wall 30 and arm 49 provides a spring action on arm 48 and backplate 10.

When a picture frame (not shown) fitted with wire 29 is hung from wall 30, wire 29 is slid into groove 18 so as to contact and rest against the curved upper surface of contact area 14. A section of wire 29 is shown in place. The weight of the picture frame pulls wire 29 snugly into groove 18 in contact with contact area 14 and backplate 10. The ends of wire 29 on either side of groove 18 hang substantially downwards and outwards along the face of backplate 10. Segment 49 of rod 40 provides a spring action against the inner surface 31 of wall 30 inhibiting the separation of backplate 10 from wall 30. As a result thereof, the friction between the surface of backplate 10 and the surface of wall 30 helps further to retain backplate 10 firmly against wall 30. The fact that point 43 is spring-pressed against inner surface 31 of wall 30 prevents any twisting of backplate 10. Also, since rod segment 48 fits tightly in hole 46, it prevents any wobbling of backplate 10.

In the embodiment shown in FIGS. 1 to 5, rod segment 27 can be extended so that rod segment 28 does not pass through hole 26 in backplate 10. Also, in the embodiment shown in FIG. 6, rod segment 45 can be extended so that rod segment 48 does not pass through hole 46 in backplate 10. Both of these alternative embodiments are not preferred embodiments since all of the stress of mounting and hanging is on weld point 42.

Figure 7:
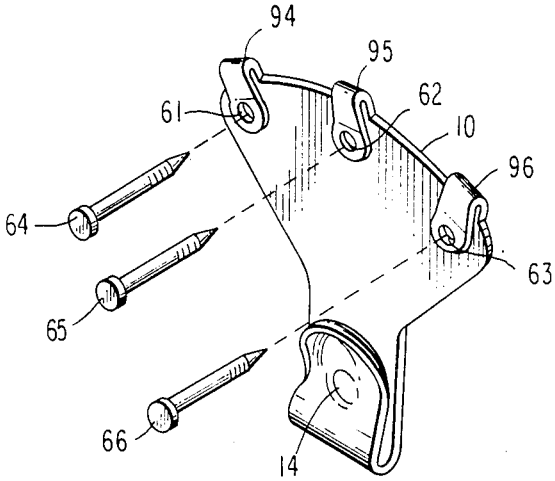
FIG. 7 is a perspective view of a further preferred embodiment of the picture hanger of the invention for attachment to hollow walls, such as, hollow wall panelling.
Figure 10:
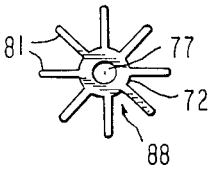
FIG. 10 is an end elevational view of the anchor shown in FIG. 9.

FIG. 7 shows an embodiment used when wall 30 is known to be made from a hard substance (e.g., press boards (wood) and some panellings) which does not permit ready or easy manual penetration of the rod 20 of FIG. 3, or the rod 40 of FIG. 6. The embodiment can also be used with hollow wall panelling and dry wall, plaster lath walls and the like. It becomes necessary to select backplate 10 having one or more holes 61, 62, ... 63. Holes 61, 62 and 63 extend through both bent over lips 94, 95 and 96, respectively, and backplate 10. The selection of the correct number of 61, 62, ... 63 is usually a matter of design choice, except in the case of when three such holes are used as shown in FIG. 7. Upon being driven into wall 30, outer nails 64 and 66 slant inwards towards center nail 65 and downwards. This provides better hold and support for backplate than when only two nails are used or some other configurations of nail holes are used. A toe-in lock of backplate to the wall is provided by the two outer nails that are positioned below and off center from the middle nail in the backplate. In the embodiment shown, hole 62 is located in the center line of backplate 10. The crucial toe-in (and toe-down) feature is achieved by providing holes in backplate 10 which correspond with holes in bent-over lips 94 and 96 in a particular manner. The center hole in backplate 10, which corresponds with the hole in bent-over central lip 95, has the same diameter as the hole in bent-over lip 95—no toe-in occurs. The means by which the toe-in is achieved with nails 64 and 65 is illustrated in FIG. 8, wherein the left side is shown. Hole 102 is punched in backplate 10 and has a diameter which is larger than that of nail 64. Hole 101 is punched in lip 94, before it is bent-over, in an off-center manner. Hole 101 has a diameter which is substantially the same as the diameter of the shaft of nail 94. When lip 94 is bent-over, as shown in FIG. 8, hole 101 is positioned so as to be off-center of hole 102. Hole 101 is far enough off-center of hole 102 so as to cover the bottom and right portions of hole 102, as viewed facing backplate 10. When the tip of nail 64 is inserted into holes 101 and 102, and then driven or hit with a hammer or similar device, nail 64 is driven into the wall in a manner which toes-in towards the vertical center line of backplate 10 (and toes-downwards). It is imperative that nails 64, 65 . . . 66, screws, or like device selected to anchor backplate 10 to wall 30 fit exactly and tightly within the corresponding holes in lips 94, 95 . . . 96. This helps provide the necessary toe-in or twist prevention. The toeing-in (and towing-down) feature provides much better support and load capability for the hanger. This embodiment allows the use of thinner nails, which provides an unobvious and economic advantage over the prior art.

Figure 11:
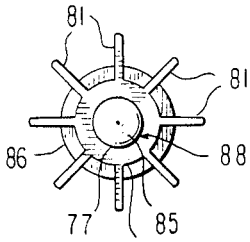
FIG. 11 is a bottom elevational view of the nail inserted in the anchor shown in FIG. 9 (without the backplate)
Figure 9:
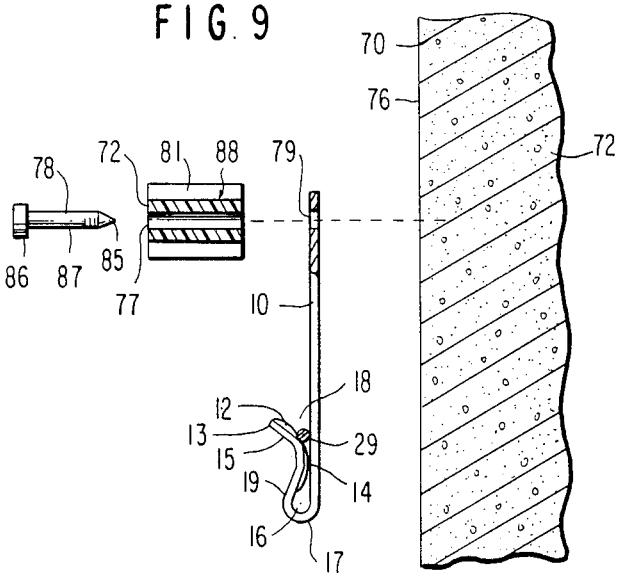
FIG. 9 is an exploded view of on embodiment of the picture hanger of the invention and means for anchoring the picture hanger to a hard wall, such as, concrete and mortar for bricks.
Figure 12:
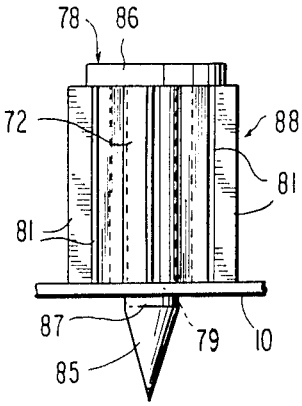
FIG. 12 is a side elevational view of the nail and anchor in place in the hole in the backplate shown in FIG. 9.

FIGS. 9 to 12 show an embodiment especially adapted for anchoring backplate 10 to wall 70 which is made of concrete, mortar brick or similar extremely hard surface, but which can also be used with hollow or solid walls made, for example, of wood, plaster, wallboard and the like. (This embodiment is not used for attachment to bricks.) Nail 78 is a concrete nail or the like and has head 86, shaft 87 and point 85. Resilient, finned sleeve 88 has center cylindrical part 72, with passageway 77 therein, and a series of fins 81 eminating therefrom. See FIG. 10. Sleeve 88 can be made of a resilient plastic or any other suitable resilient material. Any other type of or shaped resilient sleeve can be used in place of sleeve 88. Sleeve 88 fits tightly over shaft 87 of nail 86 as shown in FIGS. 11 and 12. Only point 85 and a small portion of shaft 87 protrude through hole 79. Shaft 87 tightly fits through hole 79 located in the top center portion of backplate 10 (in other words, shaft 87 should be slightly larger than passageway 77). See FIGS. 9 and 12. Head 86 of nail 78, when ready for driving into wall 70, fits flush against sleeve 88. To mount backplate 10 to wall 70, nail 78 (located in hole 79 and containing sleeve 88 thereon) is driven or pounded into wall 70. Resilient sleeve 88 acts as a shock absorber for the impact of driven nail 78 on wall 70 and prevents the shattering of wall 70 as nail 78 is driven into it. As nail 78 is driven into wall 70, sleeve 88 mushrooms out but limits the depth of penetration of nail 78 into wall 70 thereby helping to prevent the wall from shattering and the nail and local area of the wall from separating from the wall properly.

If desired, more than one hole 79 can be used in backplate 10 to accommodate more than one nail 78.

Although diverse means for anchoring the picture hanger to the surface of a wall have been shown it is obvious to anchor the picture hanger to any surface. Further, although the use of the invention has been disclosed with reference to a picture hanger, it is equally useful for suspending any other object by a flexible, elongated article. Whereas backplate 10 has been shown to be pear-shaped in the drawing, any other aesthetic shape could equally have been used. Likewise, although backplate 10 has been shown to be flat in the preferred embodiment any other surface arrangement could equally have been used.

In a preferred embodiment, segment 27 of rod 20 in FIG. 3 can be angled upwards as shown for segment 45 of rod 20 in FIG. 6. Accordingly arm 28 is lengthened in the manner shown for arm 48. This provides a spring effect and helps segment 27 adjust to different wall thicknesses.

What is claimed is:

1. A device for supporting objects having flexible, elongated hanging means, comprising:

a flat back member having a first surface and a second surface;

means for fixedly attaching said flat back member to a wall, such that said second surface is adjacent to the wall;

a lip having a convex surface facing said flat back member;

means for fixedly connecting said lip to said first surface;

a support area formed between said convex surface of said lip and said first surface for supporting a portion of the flexible, elongated hanging means; and said lip extending outwardly and upwardly from said first surface at an angle sufficient to allow the supported portion of the flexible, elongated hanging means to slide toward said first surface whereby the supported portion of said flexible, elongated hanging means is supported in a position of abutment with both said first surface and said convex surface of said lip such that a moment arm having a length being defined by the distance between the load center of the supported portion of the flexible, elongated hanging means and said first surface is reduced in length so that a moment of force about said means for fixedly attaching said flat back member is minimized.

2. The device as claimed in claim 1 wherein said convex surface of said lip includes a smooth, convexly contoured surface which is adapted to permit the supported portion of the flexible, elongated hanging means to be housed firmly between said lip and said first surface and to permit said flexible, elongated hanging means to hang freely from either side of said smooth contoured surface.

3. The device claimed in claim 1 wherein said smooth contoured surface, when said flat back member is fixedly attached to a substantially vertical surface of the wall, is adapted (i) to receive said flexible elongated hanging means directly adjacent to said first surface of said flat back member and (ii) to aid in keeping said second surface of said flat back member pressed firmly against said vertical surface.

4. The device as claimed in claim 1, further comprising:

said flat back member and said lip being fabricated from a single piece of material; and a bight protion fabricated from said single piece of material and interposed between said lip and said flat back member whereby the lower portion of said lip is fixedly connected to said flat back member adjacent said bight portion.

5. The device as claimed in claim 4, wherein said means for fixedly connecting said lip portion to said flat back member comprises a welded connection area.

6. The device as claimed in claim 1, wherein said means for fixedly attaching said flat back member to a wall comprises:

an elongated rod for penetrating the wall having opposed ends, one of said ends being fixedly connected to said first surface of said flat back member and the other of said ends having means for piercing and penetrating the wall;

said elongated rod including an intermediate, straight portion adjacent said flat back member and extending outwardly from said second surface of said flat back member whereby said straight portion extends through the wall for supporting a load placed on said device by said flexible, elongated hanging means; and said elongated rod further including a spring means portion intermediate said straight portion and said other end for biasing said other end toward said flat back member; and whereby said other end is adapted to first penetrate the outer surface of the wall to enable insertion of a portion of said elongated rod through the wall and then under the bias of said spring means portion penetrate the inner surface of the wall when said second surface of said flat back member is in contact with the outer surface of the wall for limiting the lateral movement of the device relative to the wall.

7. The device as claimed in claim 6, wherein said spring means portion comprises an elongated, curved, spring article sufficiently long to traverse at least the thickness of the wall, said elongated, curved, spring object having a concave curvature facing said flat back member.

8. A device as claimed in claim 6, wherein said means for attaching said flat back member to a wall further comprises:

said straight portion extending through said flat back member from adjacent said one end outwardly to said spring means portion in a direction perpendicular to said flat back member, said straight portion having a length at least as long as the dimension between the outer and inner surfaces of the wall.

9. The device as claimed in claim 5 wherein said means for fixedly attaching said flat back member to a wall comprises:

a plurality of headed fasteners; said flat back member having a vertical center line;

first hole means in alignment with said vertical center line for guiding one of said plurality of headed fasteners vertically downwardly;

second and third hole means spaced on either side of said first hole means for guiding the other of said plurality of headed fasteners in each of said second and third hole means vertically downwardly and respectively inwardly toward said vertical center line whereby said flat back member is fixedly attached to said wall by said headed fasteners passing through said holes and penetrating the wall.

10. A device for supporting objects as claimed in claim 1, wherein said means for fixedly attaching said flat back member to a wall includes:

a penetrating shaft having a head;

a resiliently deformable member disposed about said shaft, said resiliently deformable member being adapted to absorb shock during penetration of said penetrating shaft into said wall.

11. A device for supporting objects as claimed in claim 10, wherein said resiliently deformable member is a finned sleeve.

12. A device for suspending picture frames having flexible, elongated hanging means comprising:

a backplate;

means for attaching said backplate to a wall having a thickness;

a lip having a convex surface facing said backplate securely fastened at a point of attachment to said backplate and extending upwardly and outwardly therefrom;

an arced groove having sidewalls for supporting a portion of the flexible, elongated hanging means, one of said sidewalls being said convex surface of said lip and the other of said side walls being said backplate; and said arced groove adapted to receive the supported portion of the flexible, elongated hanging means whereby said flexible, elongated hanging means is urged to slide inwardly and downwardly to a position in abutment with both said sidewalls whereby the distance between the load center of the supported portion of the flexible, elongated hanging means and the backplate is reduced so that the outward component of force transmitted from the load of the picture frame through the supported portion of the flexible, elongated handing means, said lip, and said backplate to said means for attaching said backplate is minimized.

13. The device as claimed in claim 12 further comprising a bight for connecting said lip and said backplate below said point of attachment.

14. The device as claimed in claim 13 wherein said backplate, said convex surfaced lip and said bight are formed from a single piece of sheet metal, and said point of attachment is obtained by welding said lip to said backplate.

15. The device as claimed in claim 12 wherein said means for attaching comprises:

(a) at least one hole through the thickness of said backplate; and (b) a means for penetrating the wall through said at least one hole for anchoring said backplate to the wall.

16. The device as claimed in claim 12 wherein said means for attaching comprises an elongated, spring rod, one end of said flexible, elongated article being fastened to said backplate and an other end of said elongated, spring rod; said elongated, spring rod having a sharp point adapted to penetrate and to dig into said wall, said elongated rod tightly extending through a hole in a top portion of said flat plate.

17. The device as claimed in claim 12 wherein said means for attaching comprises an adhesive material deposited on the surface of the backplate for anchoring said backplate to said wall.

18. A device for supporting objects as claimed in claim 12, wherein said means for attaching said flat back member to a wall includes:

a penetrating shaft having a head;

a resiliently deformable member disposed about said shaft, said resiliently deformable member being adapted to absorb shock during penetration of said penetrating shaft into said wall.

19. A device for supporting objects as claimed in claim 18, wherein said resiliently deformable member is a finned sleeve.

* * * * *